US010043649B2

(12) United States Patent
Tirén

(10) Patent No.: US 10,043,649 B2
(45) Date of Patent: Aug. 7, 2018

(54) SHAPED CATHODE FOR A FIELD EMISSION ARRANGEMENT

(71) Applicant: LightLab Sweden AB, Uppsala (SE)

(72) Inventor: Jonas Tirén, Uppsala (SE)

(73) Assignee: Lightlab Sweden AB, Uppsala (SE)

( * ) Notice: Subject to any disclaimer, the term of this patent is extended or adjusted under 35 U.S.C. 154(b) by 260 days.

(21) Appl. No.: 14/773,582

(22) PCT Filed: Mar. 14, 2014

(86) PCT No.: PCT/EP2014/055124

§ 371 (c)(1),
(2) Date: Sep. 8, 2015

(87) PCT Pub. No.: WO2014/154505

PCT Pub. Date: Oct. 2, 2014

(65) Prior Publication Data

US 2016/0020084 A1 Jan. 21, 2016

(30) Foreign Application Priority Data

Mar. 25, 2013 (EP) ..... 13160768

(51) Int. Cl.
*H01J 63/06* (2006.01)
*H01J 9/02* (2006.01)
*H01J 19/24* (2006.01)

(52) U.S. Cl.
CPC ..... *H01J 63/06* (2013.01); *H01J 9/025* (2013.01); *H01J 19/24* (2013.01)

(58) Field of Classification Search
CPC ..... H01J 63/06
See application file for complete search history.

(56) References Cited

U.S. PATENT DOCUMENTS 4,818,914 A 4/1989 Brodie
6,873,095 B1 * 3/2005 Kjellman ..... B82Y 10/00 313/309
2002/0070648 A1 6/2002 Forsberg
2006/0091782 A1 5/2006 Liu
2012/0176024 A1 * 7/2012 Yang ..... H01J 63/02 313/496

FOREIGN PATENT DOCUMENTS

WO 02/47104 6/2002
WO 2005/074006 8/2005

OTHER PUBLICATIONS

Ausra Kaveckaite, International Search Report of parent PCT Application No. PCT/IB2014/055124, dated Apr. 14, 2014, European Patent Office, Rijswijk Netherlands.

* cited by examiner

*Primary Examiner* — Nimeshkumar Patel
*Assistant Examiner* — Jacob R Stern
(74) *Attorney, Agent, or Firm* — Babcock IP, PLLC

(57) ABSTRACT

The present invention relates to a field emission lighting arrangement, comprising an anode and a cathode, where the shape of the cathode is selected based on the shape of a evacuated envelope in which the anode and cathode is provided. The inventive shape of cathode allows for an improved uniformity of an electric field provided between the anode and cathode during operation of the field emission lighting arrangement. The invention also relates to a corresponding method for selecting a shape of such a cathode.

18 Claims, 5 Drawing Sheets

SHAPED CATHODE FOR A FIELD EMISSION ARRANGEMENT

TECHNICAL FIELD

The present invention relates to a field emission lighting arrangement. The present invention further relates to a method for selecting a shape of a field emission cathode for use in such a field emission lighting arrangement.

BACKGROUND OF THE INVENTION

Traditional incandescent light bulbs are currently being replaced by other light sources having higher energy efficiency and less environmental impact. Alternative light sources include light emitting diode (LED) devices and fluorescent light sources. However, LED devices are relative expensive and complicated to fabricate and fluorescent light sources are known to contain mercury, thereby posing potential health problems due to the health risks involved in mercury exposure. Furthermore, as a result of the mercury content, recycling of fluorescent light sources is both complicated and costly.

An attractive alternative light source has emerged in the form of field emission lighting. A traditional field emission lighting arrangement comprises an anode structure and a field emission cathode, the anode structure consists of a transparent electrically conductive layer and a light conversion layer, such as a layer of phosphor coated on the inner surface of an evacuated envelope, provided in the form of e.g. a transparent glass tube. The phosphor layer emits light when excited by the electrons emitted from the cathode.

Previously known field emission lighting arrangements are often in the shape of tubes and seldom in the form of the traditional bulb. Hence there is a need to provide field emission lighting arrangements with a form factor suitable for retrofitting of e.g. traditional incandescent bulbs as well as corresponding compact fluorescent light sources.

SUMMARY OF THE INVENTION

With regards to the above-mentioned desired properties of field emission lighting arrangements, it is a general object of the present invention to enable improved performance of a field emission lighting arrangement for example by improved distribution of the light emitted.

The present invention is based upon the realization that an alternative shape and position of the cathode within the evacuated envelope may provide a more uniform electric field on the outer surface of the cathode, most importantly on the upper half of the cathode surface, which will in turn provide a more uniform distribution of electrons impinging upon an electron to light conversion layer used for converting electron energy into e.g. visible light. Accordingly, this selection and/or adaptation of shape and position may enable a uniform spatial distribution of the light emitted from the field emission lighting arrangement.

According to a first aspect of the invention these and other objects are achieved by a field emission lighting arrangement, comprising a bulb shaped evacuated envelope, comprising a field emission cathode arranged along the optical axis of the field emission lighting arrangement, and an anode structure arranged along an inside of the evacuated envelope, the anode structure comprising a transparent electrically conducting layer and an electron to light conversion layer, and a base structure provided at a bottom end of the evacuated envelope, the base structure comprising a power supply electrically integrated within the base structure and connected to the anode structure and the cathode, wherein the power supply is configured to apply a voltage such that electrons are emitted from the cathode to the anode structure, wherein the field emission cathode has a shape that is selected based on the shape of the evacuated envelope and is arranged in a lower part of the evacuated envelope towards the base structure, such that a distance between the cathode and the anode structure is larger along the optical axis than along any other axis, whereby the distance between the cathode and the anode structure decreases with an increasing central angle from the optical axis, thereby improving the uniformity of the electric field.

In the context of the present invention the optical axis is defined as an axis around which there is rotational symmetry of the light output from an optical system, i.e. according to the invention being the inventive field emission lighting arrangement. An effect of selecting the shape and position of the field emission cathode based upon a (pre)determined shape of the evacuated envelope is the possibility of providing improvements in relation to the uniformity of light emitted by the field emission lighting arrangement. The form factor (i.e. shape) of the evacuated envelope is typically dictated by design considerations, possibly relating to the form factor used for retrofit lighting arrangements, e.g. retrofit light bulbs.

As such, the predetermined shape and the adaptation of the cathode structure results in a distance between the surface of the cathode and the anode structure being largest along the optical axis and the shortest distance between a surface of the cathode and the anode structure decreases with an increasing central angle from the optical axis.

A commercially viable light source must preferably have a relatively long life time. In the technical area of field emission, the lifetime of the field emission lighting arrangement is at least partly determined by the degradation of the electron to light conversion layer, being for example a lighting powder (e.g. a so called phosphor layer), specifically due to the accumulated charge per unit area, i.e. impinging current density over time. It is therefore desirable to use an anode structure where the area covered by the electron to light converting layer being as large as possible. In addition, such a commercially viable light source typically comprises the necessary driving electronics provided in the same "unit", possibly in the base of the lighting arrangement. Still further, as mentioned above, the lighting arrangement preferably has a form factor similar to light sources already commercially available today, typically light bulbs. Accordingly, as the form factor of the inventive field emission lighting arrangement preferably is similar to available light bulbs used today and at the same time the area of the anode structure should be maximized, the resulting evacuated envelope will typically be formed as a half sphere possibly with a cylindrical extension in a lower end towards the base structure in order to facilitate space for e.g. a so called pump stem (the bottom of the evacuated envelope) used for evacuating the envelope before its operation and usually supplying the electrical connection feed through to the anode and the cathode. Following the above discussion, the most natural position of the cathode is typically at the center of the sphere. As the design of the inventive lighting arrangement in this embodiment thus will differ from a full sphere, the result is that the electrical field on the cathode will be non-uniform.

The current follows the Fowler-Nordheim equation:

$$I = A_r a \frac{\beta^2 E^2}{\varnothing} e^{-\frac{b\varnothing^{3/2}}{\beta E}},$$

where $A_r$ is the effective emitter area, a is the first Fowler-Nordheim constant;

$$a = 1.54 \times 10^{-6} \left[\frac{AeV}{V^2}\right];$$

b is the second Fowler-Nordheim constant $$b = 6.83 \times 10^{9} \left[\frac{\mathrm{V}}{meV^{3/2}}\right]$$

Ø is the work function in eV and β is a dimensionless enhancement factor Accordingly, changes in electrical field will results in changes in current.

To achieve field emission at reasonable applied voltages (typically below 10 kV) specially designed structures may in one embodiment be used in order to locally enhance the field strength. A common rule of thumb is that 1 GV/m is needed for field emission to be achieved. In the present invention this may for example in one embodiment be achieved in one or preferably two steps. The macroscopic field, as defined here, is provided by the basic macroscopic geometry and the applied voltage. In this invention it is generally defined as the electrical field of a spherical symmetry, (albeit for a full spherical symmetry) given by:

$$E(r) = \frac{VR}{r(R-r)}$$

where V is the applied voltage, R is the radius of the outer sphere (the anode) and r is the radius of the inner sphere (the cathode). V is generally in the range of 1-20 kV and preferably in the range of 1-10 kV and r and R for example are determined by the desired form factor of the evacuated envelope (as discussed above). For the sake of briefness, the above macroscopic electrical field is further now simply referred to as the "field" or the "electrical field".

In order to reach sufficient field strength to achieve field emission the macroscopic field is preferably, in one embodiment of the present invention, amplified by adding geometries down to the nanometer level. The first (and in some cases optional) step is to enhance the macroscopic electrical field locally on the cathode surface by adding microscopic protrusions to the cathode spherical surface. The second step is to use nanostructures. Both are described briefly further below.

As light output in general can be regarded as proportional to the current (within certain limits), it is vital to keep the macroscopic electrical field uniform on the cathode surface, if a uniform light output is desired. A non-uniform electrical field strength at the cathode surface may typically result in a non-uniform emission of electrons, which will result in a non-uniform irradiation of the electron to light conversion layer and in turn a non uniform light output. In order to achieve this in a practical manner the macroscopic field should preferably be as uniform as possible over the relevant area of the cathodes surface, generally approximately the upper half of the cathode. Alternatively, it may according to the invention be possible to carefully control the distribution of the size of the microscopic protrusions over the relevant part of the cathode surface.

As discussed above, the electron to light conversion layer may for example comprise a phosphor layer configured to convert energy from impinging electrons to light. Alternatively, it may also be possible to introduce or instead use quantum dots for converting energy from impinging electrons into light.

According to one embodiment of the invention, the distance between the cathode and the anode structure varies between 0.1 and 100 mm, preferably between 0.2 and 70 mm and most preferably between 0.5 mm and 40 mm. Furthermore, a field emission lighting arrangement in this size may for example be comparable to a standard A19 light bulb, which may make it suitable for many lighting fixtures in use today. Other types of predetermined shapes are of course possible and within the scope of the invention.

According to another embodiment of the invention, the cathode is shaped essentially ellipsoidal, with an essentially circular cross-section on the plane which has a normal aligned with the optical axis, and the ratio between the semi axis aligned with the normal (a) and the other two semi axes (b) is such that the ratio b/a lies in the range between 1.05 and 2. Making the cathode into a flattened spherical shape may provide a uniform electrical field strength within the evacuated envelope due to the essentially ellipsoidal shape, i.e. well in line with the above discussion.

In one embodiment of the invention, the selection of cathode shape provides an electrical field strength that differ less than 50%, more preferably less than 20% and most preferably less than 10% at all relevant points of the cathode surface. The selection of cathode shape typically provides electron trajectories resulting in a uniform electric current density in the anode structure.

According to yet another embodiment of the invention the field emission lighting arrangement may further comprise an electrically conductive structure arranged between the evacuated envelope and the base structure (i.e. typically outside of the evacuated envelope). The electrically conductive structure is according to the invention preferably arranged at an electrical potential $V_p$ with respect to an electrical potential of the cathode $V_c$ such that $V_p - V_c$ is positive, and based on an electrical potential of the anode structure $V_a$ such that $(V_p - V_c)/(V_a - V_c)$ is in the range of 0 to 2, thereby further adjusting the electron trajectories to be received by a lower area of the anode structure, i.e. being closer to the base structure, in order to further improve the area of the anode structure receiving electrons from the cathode. Such an electrically conductive structure may in addition protect the power supply from electrons impinging towards the base structure, and also protect the cathode and the evacuated envelope from disturbing and varying electromagnetic fields originating from the power supply. Furthermore such an electrically conductive structure may be made so that its upper surface reflect light which has been emitted inwards instead of outwards from the anode structure and further enhance the total light emitted from the field emission lighting arrangement. As an alternative, the electrically conductive structure may be arranged on the inner surface of the bottom part of the evacuated envelope.

According to another embodiment of the invention the cathode may further comprise, an array of protruding base structures arranged on a substrate, wherein the protruding base structures are arranged to have a center-to-center distance of 10 μm to 100 μm, more preferably 10 μm to 60 μm, and most preferably 10 μm to 40 μm and a height of 5 to 60 μm and at least one nanostructure arranged on each of the protruding base structures.

A protruding base structure may be advantageous regarding the voltage that needs to be applied over the cathode in order to achieve field emission from the nanostructure arranged on the base structure as described above. For a surface without protruding base structures, a higher voltage is required to achieve field emission in contrast to the presented structure where the voltage is concentrated to the protruding base structures thereby resulting in a higher electric field at the position of the nanostructures acting as field emitters.

In the present context, the term nanostructure refers to a structure where at least one dimension is on the order of up to a few hundreds of nanometers. Such nanostructures may for example include nanotubes, nanorods, nanowires, nanopencils, nanospikes, nanoflowers, nanobelts, nanoneedles, nanodisks, nanowalls, nanofibres and nanospheres. Furthermore, the nanostructures may also be formed by bundles of any of the aforementioned structures. The preferred direction of the nanostructures is in a direction essentially perpendicular to the cathode surface. According to one embodiment of the invention the nanostructures may comprise ZnO nanorods.

According to an alternative embodiment of the invention the nanostructure may include carbon nanotubes. Carbon nanotubes may be suitable as field emitter nanostructures in part due to their elongated shape which may concentrate and produce a higher electric field at their tips and also due to their electrical properties.

In one embodiment of the invention the protruding base structures are shaped as square pyramids. Preferably the protruding base structures are shaped as square pyramids which may provide a sharp well defined tip which may further concentrate the electrical field, and may provide a higher electrical field for the nanostructures as field emitters. Other types of protruding base structures, such as cylinders, square protrusions, any irregular protruding geometry or the like, are of course possible and within the scope of the invention. According to one embodiment of the invention the protruding base structure shaped as square pyramids having a base size of 20 μm to 40 μm.

According to another embodiment of the invention the bulb shaped evacuated envelope has a form as half-spherical, half-parabolic or half-ellipsoidal and comprising a cylindrical, conical or straight connection to the base structure. The connection to the base structure may provide the ability to position the cathode along the optical axis at different points within the evacuated envelope, advantageously this may allow for a uniform electric field when the cathode shape is limited.

Furthermore, this feature may also provide the ability to use the field emission lighting arrangement as a retrofit into standard incandescent light bulb sockets e.g. an Edison screw base. In addition, a field emission lighting arrangement in this size may be comparable to a standard A19 light bulb, which may make it suitable for many lighting fixtures in use today.

According to another aspect of the invention there is provided a method for selecting a shape of a field emission cathode for use in a field emission lighting arrangement, the field emission lighting arrangement comprising a bulb shaped evacuated envelope having an anode structure arranged along an inside of the evacuated envelope, the anode structure comprising a transparent electrically conducting layer and an electron to light conversion layer, and a base structure provided at a bottom end of the evacuated envelope, wherein the field emission cathode is arranged along the optical axis of the field emission lighting arrangement and in a lower part of the evacuated envelope towards the base structure, wherein the method comprises determining a shape of the inside of the evacuated envelope covered by the anode structure, determining a spatial relation between the position at which the field emission cathode is arranged in the lower part of the evacuated envelope in correlation with the anode structure, and selecting the shape of the field emission cathode such that a distance between the field emission cathode and the anode structure at the inside of the evacuated envelope is larger along the optical axis than along any other axis, whereby the distance between the field emission cathode and the anode structure decreases with an increasing central angle from the optical axis. This aspect provides similar advantages as in relation to the previous aspect of the invention.

Further features of, and advantages with, the present invention will become apparent when studying the appended claims and the following description. The skilled addressee realize that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

DETAILED DESCRIPTION

Figure 1:
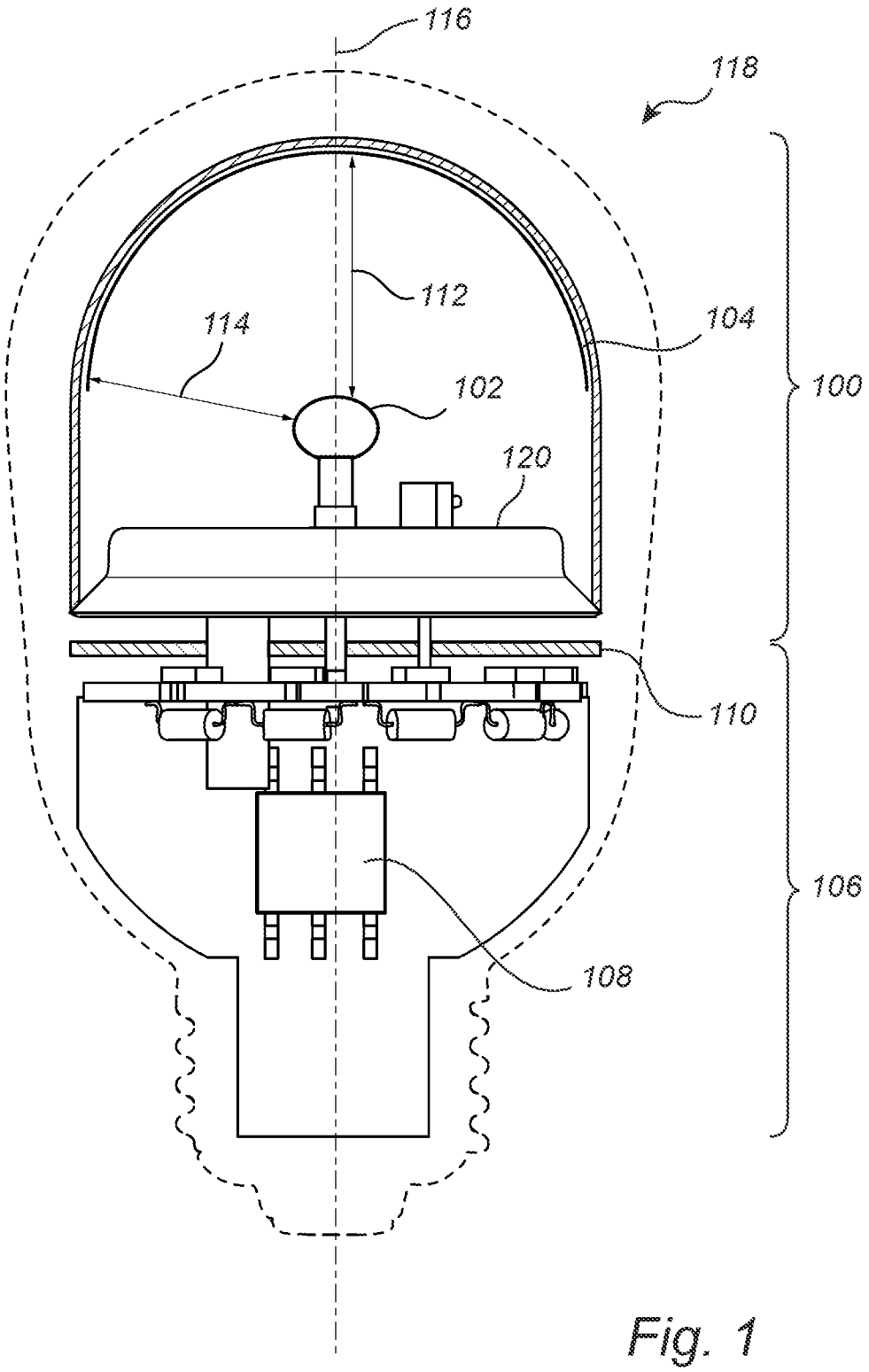
FIG. 1 schematically illustrates a cross-section of the field emission lighting arrangement according to an embodiment of the invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

In the present detailed description, an embodiment of a field emission lighting arrangement according to the present invention is mainly discussed with reference to a field emission lighting arrangement comprising a cathode with an essentially elliptical shape. It should be noted that this by no means limit the scope of the invention, which is also applicable in other circumstances, for example for use with otherwise shaped evacuated envelopes or cathodes.

The invention will now be described with references to the enclosed drawings where first attention will be drawn to the structure, and secondly, functions of the field emission lighting arrangement will be described.

In FIG. 1, the field emission lighting arrangement 118 is represented through a cross-section (i.e. side-view), where the evacuated envelope 100 and an anode structure 104 along an inside of the evacuated envelope 100 are shown. The anode structure 104 comprises a transparent electrically conducting layer and an electron to light conversion layer, such as a phosphor layer, e.g. using standard phosphors such as P22 (and/or e.g. quantum dots as mentioned above). Furthermore a field emission cathode 102 having a slightly elliptical form (as is discussed above as well as elaborated below) is arranged along the optical axis 116 of the field emission lighting arrangement 118, and is arranged in the lower end of the evacuated envelope 100 adjacently to a base structure 106 of the field emission lighting arrangement 118. It should be noted that the field emission cathode 102 in the illustrated embodiment, and preferably according to the present invention, has a circular form when seen from above (i.e. top-view, also visible from FIG. 3). The optical axis extends through a center point within the cathode.

The base structure 106 comprises a power supply 108 which is electrically connected (not shown) to the transparent electrical conductive layer of the anode structure 104 and to the cathode 102. The power supply may preferably deliver a DC (direct current) voltage to the anode structure 104 and the cathode 102. Other alternatives are possible and within the scope of the invention. In the embodiment shown in FIG. 1, the field emission lighting arrangement 118 further comprises an electrically conductive structure 110 in the form of e.g. a conductive "shield", "foil" or "plate" being electrically connected (not shown) to the power supply 108.

A first arrow 112 shows the distance from the cathode 102 to the anode structure 104 along the optical axis 116, and a second arrow 114 shows the distance from a surface of the cathode 102 to the anode structure 104 along another axis also extending through the center point of the cathode. That is, the second arrow 114 is angled as compared to the optical axis 116. The distance along the first arrow 112 is larger than along the second arrow 114, this is due to the shape and position of the cathode 102. Furthermore the distance between the cathode 102 and the anode structure 104 decreases smooth and continuously as a function of the central angle from the optical axis 116 indicated by the second arrow 114. In FIG. 1, a typical pump stem 120 for the evacuated envelope 100 is additionally shown. As such, the shortest distance between the surface of the cathode and the anode structure increases with the angle between the first 112 and the second 114 arrow.

Figure 2A:
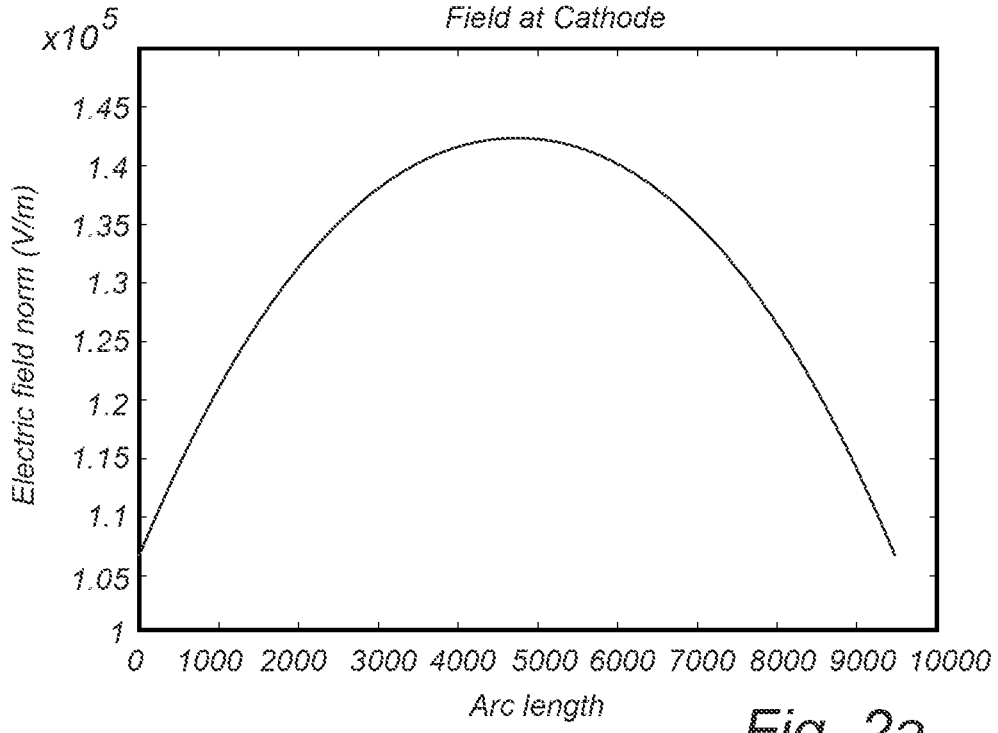
FIGS. 2*a*-2*e* illustrates examples of not applying as well as applying the inventive concept of an adequately shaped cathode, possibly in combination with an electrically conductive structure as discussed above.
Figure 2B:
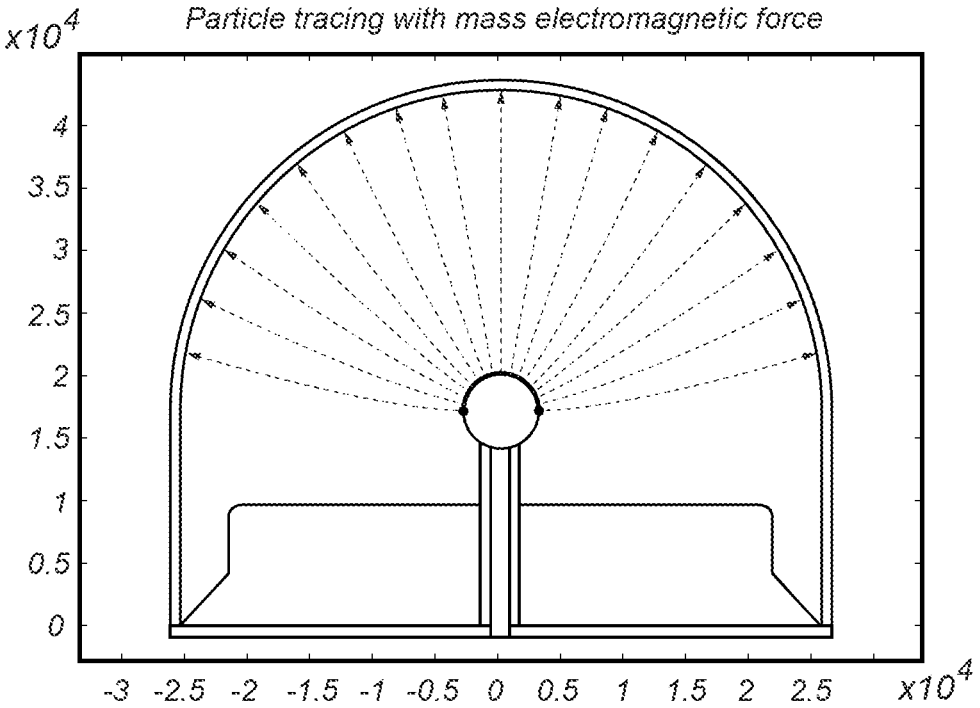

In FIG. 2*a*, a graph of the electric field strength along a circumference of a cathode is shown; the electric field strength values (please note, absolute values are not of interest as they depend on the voltage applied) in FIG. 2*a* are calculated from spherical cathode geometry (i.e. a typical prior art field emission cathode). The arc length described starts at a −90 degree angle from the optical axis and ends at a +90 degree angle from the optical axis (as is indicated by the point-bolded line at the upper end surface of the cathode). It is apparent from FIG. 2*a* that the largest values of the electric field strength in the case of a spherical cathode are in the direction of the optical axis and that the perpendicular direction from the optical axis has lower electrical field strength, and more importantly that the variation is high. In use, a spherical cathode will then produce an increased emission of electrons towards the optical axis and less at the directions perpendicular to the same axis and will not provide a uniform distribution of the light emitted. The corresponding electron trajectories provided in relation to a prior art field emission lighting arrangement are seen in FIG. 2*b*.

Figure 2C:
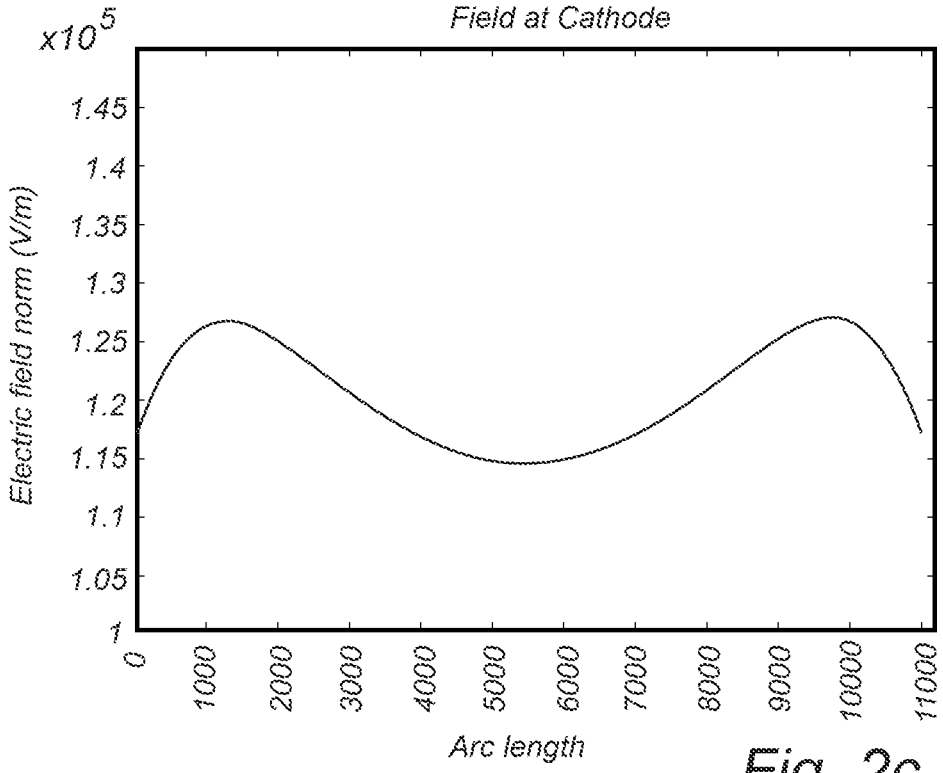
Figure 2D:
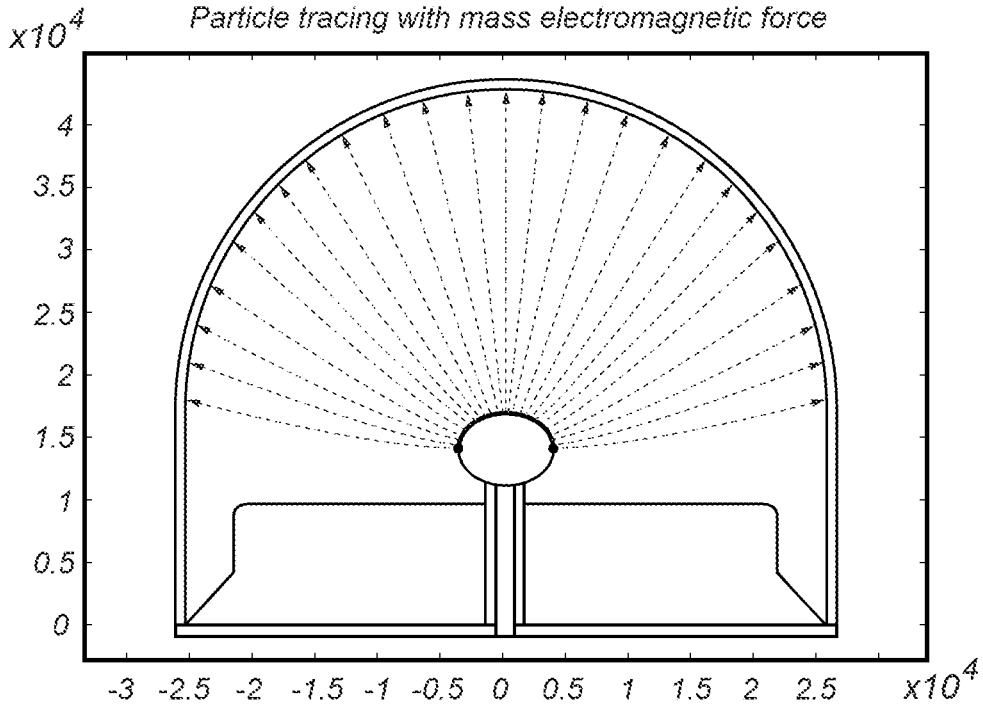

In FIG. 2*c* a graph of the electric field strength along a circumference comprising the optical axis of a cathode is shown, the electric field strength values in FIG. 2*c* are from an essentially ellipsoidal cathode, positioned in a more ideal manner below the centre of the half sphere part of the evacuated envelope (preferably between 0-5 mm below) according to the present invention, e.g. as shown in relation to the field emission lighting arrangement 118 of FIG. 1. The information provided through the illustration of FIG. 2*c* teaches that the electrical field strength along a circumference comprising the optical axis of a cathode according to the present invention will provide an (improved and) essentially uniform electrical field strength on the surface of the cathode as compared to the prior art illustration of FIGS. 2*a* and 2*b*. The resulting field strength will, in use, provide essentially uniform distribution of the electrons emitted towards the anode structure. The electrons impinging upon the anode structure (typically comprising the electron to light conversion layer, such as the phosphor layer), will produce light upon impact of the electron to light conversion layer through excitations of e.g. the phosphor material used for the conversion process, and thereby produce an essentially uniform spatial distribution of the light emitted from the field emission lighting arrangement. In a corresponding manner, the adjusted electron trajectories provided in line with the inventive concept are illustrated in relation to FIG. 2*d*.

Figure 2E:
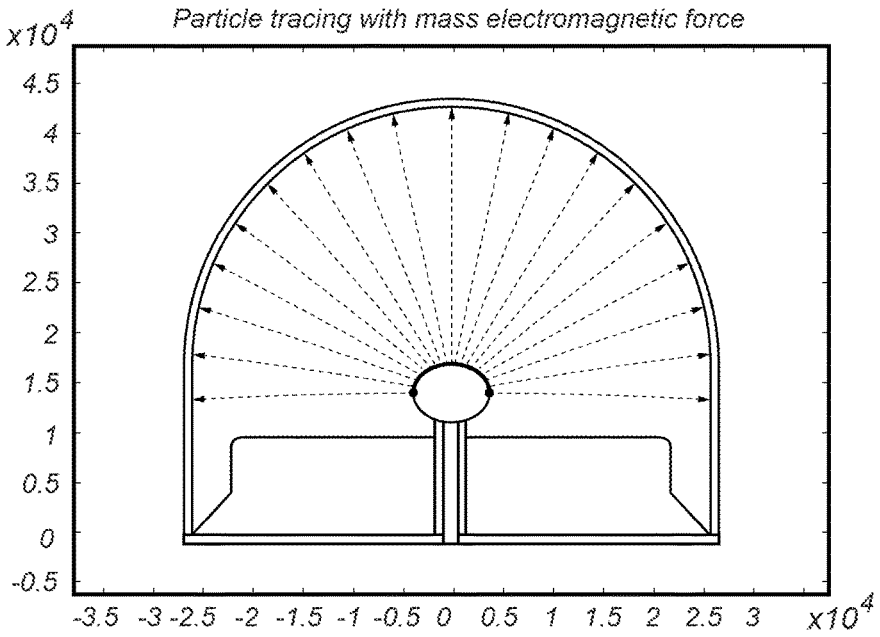

Introducing the novel cathode shape having an optimized shape and arranged at an optimized position the field uniformity may be greatly improved, as illustrated in FIG. 2*c* to be around +/−5%. As can be seen from FIG. 2*d*, the corresponding electron trajectories are adjusted in a corresponding manner such that they now cover almost the half sphere of the evacuated envelope. When additionally introducing the electrically conductive structure 110 (e.g. using a potential of V=V(anode)) towards the lower end of the evacuated envelope, the electron trajectories are still further improved such that more than the half sphere will be covered by emitted electrons. This concept is further illustrated in FIG. 2*e*.

Functional aspects from the features of the field emission lighting arrangement 118 will now be explained together with FIG. 3 which represents a currently preferred embodiment of the field emission lighting arrangement 118 illustrated in FIG. 1.

Figure 3:
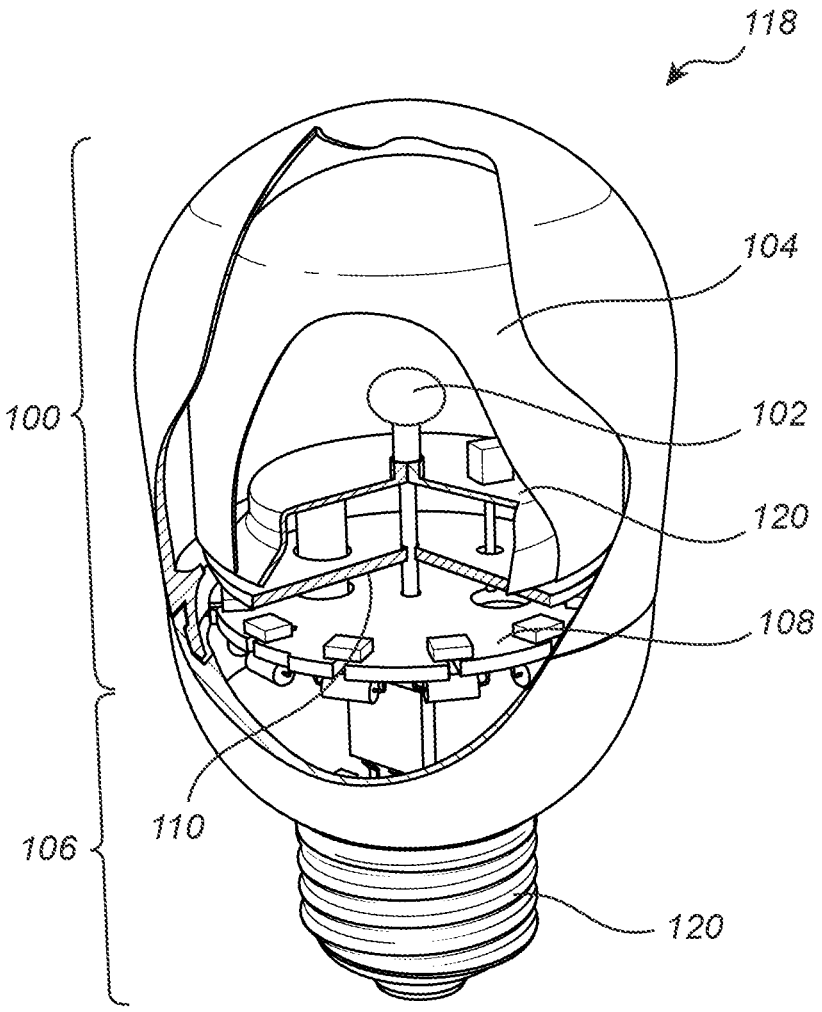
FIG. 3 is a view of the field emission lighting arrangement according to a currently preferred embodiment of the invention.

In FIG. 3, the power supply 108 electrically connected to the cathode 102 and the anode structure 104, will supply a potential difference between the cathode 102 and the anode structure 104. Typical values of the potential difference are within the range of 4-12 kV, (the anode potential being "more" positive than the cathode potential) which will be adapted to the specific application and embodiment of the invention, smaller or larger potential differences might be preferred or other ranges are also within the scope of the invention. The potential difference will during operation of the field emission lighting arrangement 118 effect the emission of electrons from the cathode 102 towards the anode structure 104, the electrons impinging upon the anode structure 104, which comprises the above discussed transparent electrically conducting layer as well as the electron to light conversion layer, will first encounter the electron to light conversion layer and cause photons to be emitted from/by the electron to light conversion layer. The photons will travel through the transparent electrically conducting layer and will reach an observer, light a room or another area where light is desired.

Furthermore the cathode 102 in FIG. 3 is shaped and positioned according to the present invention, it has an elliptical shape and position within the evacuated envelope selected based on the bulb shaped evacuated envelope 100 in such a way that the uniformity of the electric field strength is improved which will provide an uniform spatial distribution of the light emitted from the field emission lighting arrangement 118. That is, the process for determining the shape of the field emission cathode 102 typically include determining the shape of the inside of the evacuated envelope 100 covered by the anode structure 104, determining a spatial relation as shown with the arrows of FIG. 1 between the position at which the field emission cathode 102 is arranged in the lower part of the evacuated envelope 100 in correlation with the anode structure 104, and then selecting the shape of the field emission cathode 102 such that a distance between the field emission cathode 102 and the anode structure 104 both arranged at the inside of the evacuated envelope 100 is larger along the optical axis than along any other axis, whereby the distance between the field emission cathode 102 and the anode structure 104 decreases with an increasing central angle from the optical axis, thus resulting in the essentially elliptically shaped cathode as seen in all of FIGS. 1, 2*b*, 2*d*, 2*e* and 3.

Moreover the electrically conductive structure 110 is shown in the currently preferred embodiment in FIG. 3, being connected to the power supply 108 and biased by a potential adapted to the specific application. The electrically conductive structure 110 is configured to protect the power supply from electrons emitted by the cathode 102; by biasing the electrically conductive structure 110 with a potential further protection of the power supply 108 will be achieved. Another purpose of biasing the electrically conductive structure 110 with a potential might be further increase of the electric field strength. In the currently preferred embodiment shown in FIG. 3, a connecting portion 120 of the base structure 106 is also included; the connecting portion is adapted to fit into a standard light bulb socket.

Although the figures may show a specific order of method steps, the order of the steps may differ from what is depicted. Also two or more steps may be performed concurrently or with partial concurrence. Such variation may for example depend on system and design considerations. All such variations are within the scope of the disclosure. Additionally, even though the invention has been described with reference to specific exemplifying embodiments thereof, many different alterations, modifications and the like will become apparent for those skilled in the art. Variations to the disclosed embodiments can be understood and effected by the skilled addressee in practicing the claimed invention, from a study of the drawings, the disclosure, and the appended claims. Furthermore, in the claims, the word "comprising" does not exclude other elements or steps, and the indefinite article "a" or "an" does not exclude a plurality.

The invention claimed is:

1. A field emission lighting arrangement, comprising:

a bulb shaped evacuated envelope, comprising:

a field emission cathode arranged along the optical axis of the field emission lighting arrangement, and an anode structure arranged along an inside of the evacuated envelope, the anode structure comprising a transparent electrically conducting layer and an electron to light conversion layer, and a base structure provided at a bottom end of the evacuated envelope, the base structure comprising a power supply electrically integrated within the base structure and connected to the anode structure and the cathode, wherein the power supply is configured to apply a voltage such that electrons are emitted from the cathode to the anode structure, wherein the field emission cathode has an essentially ellipsoidal form factor—that is selected based on a predetermined shape of the evacuated envelope and is arranged in a lower part of the evacuated envelope towards the base structure, wherein a distance between the surface of the cathode and the anode structure is largest along the optical axis and the shortest distance between a surface of the cathode and the anode structure decreases with an increasing central angle from the optical axis; and the cathode has an essentially circular cross-section on the plane which has a normal aligned with the optical axis, and the ratio between the semi axis aligned with the normal and the other two semi axes is between 1.05 and 2.

2. The field emission lighting arrangement according to claim 1, wherein the distance between the surface of the cathode and the anode structure varies between 0.1 and 100 mm.

3. The field emission lighting arrangement according to claim 1, wherein the selection of cathode shape provides an electrical field strength that differ less than 50% at all points of the cathode surface.

4. The field emission lighting arrangement according to claim 1, wherein the selection of cathode shape provides electron paths resulting in a uniform electric current density in the anode structure.

5. The field emission lighting arrangement according to claim 1, wherein the field emission lighting arrangement further comprises:

an electrically conductive structure arranged between the evacuated envelope and the base structure.

6. The field emission lighting arrangement according to claim 5, wherein the electrically conductive structure is arranged at an electrical potential $V_p$ with respect to an electrical potential of the cathode $V_c$ such that $V_p-V_c$ is positive, and based on an electrical potential of the anode structure $V_a$ such that $(V_p-V_c)/(V_a-V_c)$ is in the range of 0 to 2.

7. The field emission lighting arrangement according to claim 1, wherein the cathode further comprises:

an array of protruding base structures arranged on a substrate of the cathode, wherein the protruding base structures are arranged to have a center-to-center distance of 10 μm to 100 μm, and at least one nanostructure arranged on at least a portion of the protruding base structures.

8. The field emission lighting arrangement according to claim 7, wherein the nanostructure comprises at least one ZnO nanorod.

9. The field emission lighting arrangement according to claim 7, wherein the nanostructure comprises at least one carbon nanotube.

10. The field emission lighting arrangement according to claim 7, wherein the protruding base structure are shaped as square pyramids.

11. The field emission lighting arrangement according to claim 10, wherein the protruding base structure shaped as square pyramids having a base size of 10 μm to 100 μm.

12. The field emission arrangement according to claim 1, wherein the bulb shaped evacuated envelope is half-spherical, half-parabolic or half-ellipsoidal and has a cylindrical, conical or straight connection to the base structure.

13. The field emission lighting arrangement according to claim 7, wherein the base structures are provided with a plurality of nanostructures at least partly randomly arranged thereon.

14. A method for selecting a shape of a field emission cathode for use in a field emission lighting arrangement, the field emission lighting arrangement comprising:

a bulb shaped evacuated envelope having an anode structure arranged along an inside of the evacuated envelope, the anode structure comprising a transparent electrically conducting layer and an electron to light conversion layer, and a base structure provided at a bottom end of the evacuated envelope, wherein the field emission cathode is arranged along the optical axis of the field emission lighting arrangement and in a lower part of the evacuated envelope towards the base structure, wherein the method comprises:

determining a shape of the inside of the evacuated envelope covered by the anode structure;

determining a spatial relation between the position at which the field emission cathode is arranged in the lower part of the evacuated envelope in correlation with the anode structure;

selecting an essentially ellipsoidal form factor of the field emission cathode such that a distance between the field emission cathode and the anode structure at the inside of the evacuated envelope is largest along the optical axis and the shortest distance between a surface of the cathode and the anode decreases with an increasing central angle from the optical axis;

arranging an array of protruding base structures on a substrate of the cathode, wherein the protruding base structures are arranged to have a center-to-center distance of 10 μm to 100 μm; and arranging at least one nanostructure on at least a portion of the protruding base structures.

15. The method according to claim 14, wherein the field emission lighting arrangement further comprises an electrically conductive structure arranged between the evacuated envelope and the base structure.

16. A field emission lighting arrangement, comprising:

a bulb shaped evacuated envelope, comprising:

a field emission cathode arranged along the optical axis of the field emission lighting arrangement, and an anode structure arranged along an inside of the evacuated envelope, the anode structure comprising a transparent electrically conducting layer and an electron to light conversion layer, a base structure provided at a bottom end of the evacuated envelope, the base structure comprising a power supply electrically integrated within the base structure and connected to the anode structure and the cathode, wherein the power supply is configured to apply a voltage such that electrons are emitted from the cathode to the anode structure, wherein the field emission cathode has a shape that is selected based on a predetermined shape of the evacuated envelope and is arranged in a lower part of the evacuated envelope towards the base structure, wherein a distance between the surface of the cathode and the anode structure is largest along the optical axis and the shortest distance between a surface of the cathode and the anode structure decreases with an increasing central angle from the optical axis; and the distance between the surface of the cathode and the anode structure varies between 0.5 and 40 mm.

17. The field emission lighting arrangement according to 16, wherein the selection of cathode shape provides an electrical field strength that differ less than 10% at all points of the cathode surface.

18. The field emission lighting arrangement according to claim 17, wherein the field emission lighting arrangement further comprises:

an electrically conductive structure arranged between the evacuated envelope and the base structure.

* * * * *